US006437225B1

(12) United States Patent
Shigenaga

(10) Patent No.: US 6,437,225 B1
(45) Date of Patent: Aug. 20, 2002

(54) COMPACT STAND FOR MUSICAL INSTRUMENT

(75) Inventor: Fumihiro Shigenaga, Shizuoka (JP)

(73) Assignee: Yamaha Corp. (JP)

( * ) Notice: Subject to any disclaimer, the term of this patent is extended or adjusted under 35 U.S.C. 154(b) by 0 days.

(21) Appl. No.: 09/611,194

(22) Filed: Jul. 6, 2000

(30) Foreign Application Priority Data

Jul. 7, 1999 (JP) ..... 11-192720

(51) Int. Cl.[7] ..... G10D 13/02
(52) U.S. Cl. ..... 84/422.3; 84/422.2; 84/422.1
(58) Field of Search ..... 84/422.3, 422.1, 84/422.2, 421

(56) References Cited

U.S. PATENT DOCUMENTS 4,517,876 A * 5/1985 Duhon ..... 84/422.3
5,018,426 A * 5/1991 Suzuki ..... 84/422.3
5,105,706 A 4/1992 Lombardi
5,266,733 A * 11/1993 Jacobson ..... 84/422.3
5,566,915 A * 10/1996 Hansare ..... 248/188.8

FOREIGN PATENT DOCUMENTS

JP 10-232670 9/1998

OTHER PUBLICATIONS

European Search Report mailed Feb. 28, 2001.
Patent Abstracts of Japan, vol. 1998, No. 14, Dec. 31, 1998 & JP 10–232670 A (Hoshino Gakki KK), Sep. 2, 1998, *abstract*.

* cited by examiner

*Primary Examiner*—Shih-Yung Hsieh
(74) *Attorney, Agent, or Firm*—Dickstein, Shapiro, Morin & Oshinsky LLP

(57) ABSTRACT

A high hat stand has a foot pedal connected to an extension rod slidable inside of a telescopic guide for crashing a top cymbal connected to the extension rod against a bottom cymbal connected to the telescopic guide, a foot member is located in an area opposite to the area occupied by the foot pedal with respect to the telescopic guide, and the foot member is connected to the telescopic guide by means of a single leg so that a player can arrange drums in crowed fashion together with the high hat cymbals.

18 Claims, 6 Drawing Sheets

COMPACT STAND FOR MUSICAL INSTRUMENT

FIELD OF THE INVENTION

This invention relates to a stand for a percussion instrument and, more particularly, to a stand for keeping cymbals over the floor.

DESCRIPTION OF THE RELATED ART

A typical example of the stand for a percussion instrument is shown in FIG. 1. The prior art stand is called as "high hat stand", and keeps high hat cymbals 1/2 within ready reach of a player. The prior art high hat stand comprises a telescopic guide 3, an extension rod 4, a foldable tripod 5 and a frame 6. Plural pipes 7/8, a coupling 9 and a thumbscrew 10 constitute the telescopic guide 3. A threaded hole is formed in the coupling 9, and the coupling 9 is attached to the pipe 7. The pipe 8 is stretchable from and retractable into the pipe 7, and the thumbscrew 10 fixes the pipes 7/8 to a current relative position. The extension rod 4 is inserted into the telescopic guide 3, and projects from both ends of the telescopic guide 3. The bottom cymbal 1 is fixed to the upper end of the pipe 8, and the top cymbal 2 is fixed to the extension rod 4. When the extension rod 4 is pulled into the telescopic guide 3, the top cymbal 2 is crashed against the bottom cymbal 1.

The foldable tripod 5 includes three legs 5*a*/5*b*/5*c*, retainer rings 11/12 and three foldable stays 13/14/15. The three legs 5*a*/5*b*/5*c* are connected at upper ends thereof to the retainer ring 11, and the retainer ring 11 is fixed to the pipe 7. The other retainer ring 12 is also fixed to the pipe 7, and is closer to the floor than the retainer ring 11. The three legs 5*a*/5*b*/5*c* are angularly spaced at 120 degrees. The foldable stays 13/14/15 are connected at the inner ends thereof to the retainer ring 12 and at the outer ends thereof to the legs 5. When the stays 13/14/15 are stretched, the tripod 5 braces the legs 5*a*/5*b*/5*c* on the floor, and keeps the guide 3 and, accordingly, the high hat cymbals 1/2 upright.

The frame 6 has an L-letter shape, and the pipe 7 is fixed to the vertical portion of the frame 6. The frame 6 is placed on the floor, and the bottom portion of the frame 6 is held in contact with the floor.

The prior art high hat stand further comprises a foot pedal 20 and a spring unit 21. The foot pedal 20 includes a heel 22 and a foot board 23. The heel 22 may be integral with the bottom portion of the frame 6, and the foot board 23 is hinged at one end thereof to the heel 22 and at the other end thereof to the extension rod 4.

The spring unit 21 includes a cylindrical case 24, a return spring (not shown) and a plunger 25. The cylindrical case 24 is fixed to the pipe 7, and the return spring is accommodated in the cylindrical case 24. The return spring is connected at one end thereof to the cylindrical case 24 and at the other end thereof to the plunger 25. The plunger 25 downwardly projects from the cylindrical case 24, and is connected to the extension rod 4. Thus, the spring unit 21 is connected between the guide 3 and the extension rod 4, and urges the extension rod 4 upwardly. This results in that the top cymbal 2 is spaced from the bottom cymbal 1 and that the foot board 23 is pulled up over the bottom portion of the frame 6.

A problem is encountered in the prior art high hat stand in that the leg 5*b*/5*c* is an obstacle to the player. In detail, when the stays 13/14/15 are stretched, the legs 5*a*/5*b*/5*c*, the guide 3 and the foot pedal 20 are located on the floor as shown in FIG. 2. The foot pedal 20 is opposed to the leg 5*a* with respect to the guide 3, and the legs 5*b* and 5*c* are located on both sides of the foot pedal 20. The legs 5*a*/5*b*/5*c* are equally spaced from one another, and the angle θ between two adjacent legs 5*a*/5*b*/5*c* is 120 degrees.

The set of high hat cymbals is used as a member of a drum set, and the prior art high hat stand is arranged around a drummer together with other drums and cymbal. It is rare that the high hat cymbals 1/2 are placed just in front of the drummer. The high hat cymbals are usually placed on either side of the drummer, and the drums are crowded around the drummer together with the high hat stand. This means that the space among the percussion instruments is narrow.

While the drummer is beating other percussion instruments, he rests the foot on the floor, or repeats the step on the foot pedal for another percussion instrument such as a bass drum. In order to generate the clapping sound from the high hat cymbals, he moves the foot onto the foot board 23 before crashing the high hat cymbals 1/2, and steps on the foot board 23. He is liable to hit his leg against the leg 5*b*/5*c*, and feels the leg 5*b*/5*c* obstacle.

A solution of the problem is a high hat stand disclosed in Japanese Patent Publication of Unexamined Application No. 10-232670 and U.S. Pat. No. 5,105,706. The prior art high hat stand has two legs spread from a guide pipe. The guide pipe upwardly projects from a frame, and a foot pedal is assembled with the frame. The two legs cooperate with the foot pedal so as to keep the guide pipe stable on the floor. The two legs are opposed to the foot pedal with respect to the guide pipe, and any leg is not located on both sides of the foot pedal. Thus, the prior art high hat stand expands the space around the foot pedal, and allows the player to easily access the foot pedal.

Although the legs are decreased from three to two, the two legs are still required for the prior art high hat stand, and are spread from the guide pipe toward the floor. As described hereinbefore, the high hat cymbals are usually used together with other percussion instruments such as drums, and the high hat stand and the drums are arranged around the player in crowed fashion. The prior art two-leg high hat stand vacates the space on both sides of the foot pedal, and allows the player to easily access the foot pedal. However, the prior art two-leg high hat stand does not allow another instrument to occupy the space between the two-legs and the guide pipe. This results in that the prior art two-leg high hat stand makes the space opposite to the foot pedal crowded. In other words, the prior art two-leg high hat stand is still an obstacle to the compact arrangement of percussion instruments.

SUMMARY OF THE INVENTION

It is therefore an important object of the present invention to provide a stand for percussion instrument which is compactly arranged together with other percussion instruments.

To accomplish the object, the present invention proposes to support a guide member by using a footing member connected through a single leg thereto.

In accordance with one aspect of the present invention, there is provided a stand for a musical instrument, comprising a holder for keeping the musical instrument over a surface, a driver placed on the surface, connected to the holder for keeping the holder and the musical instrument over the surface and linked with the musical instrument so that a player produces sound by actuating the musical instrument through the driver, and a position sustainer for preventing the holder and the musical instrument from falling and including a single leg having one end portion connected to the holder and extending toward the surface and a footing member connected to the other end portion of the single leg and held in contact with the surface.

BRIEF DESCRIPTION OF THE DRAWINGS

The features and advantages of the stand for a percussion instrument will be more clearly understood from the following description taken in conjunction with the accompanying drawings in which.

DESCRIPTION OF THE PREFERRED EMBODIMENTS

First Embodiment

Figure 1:
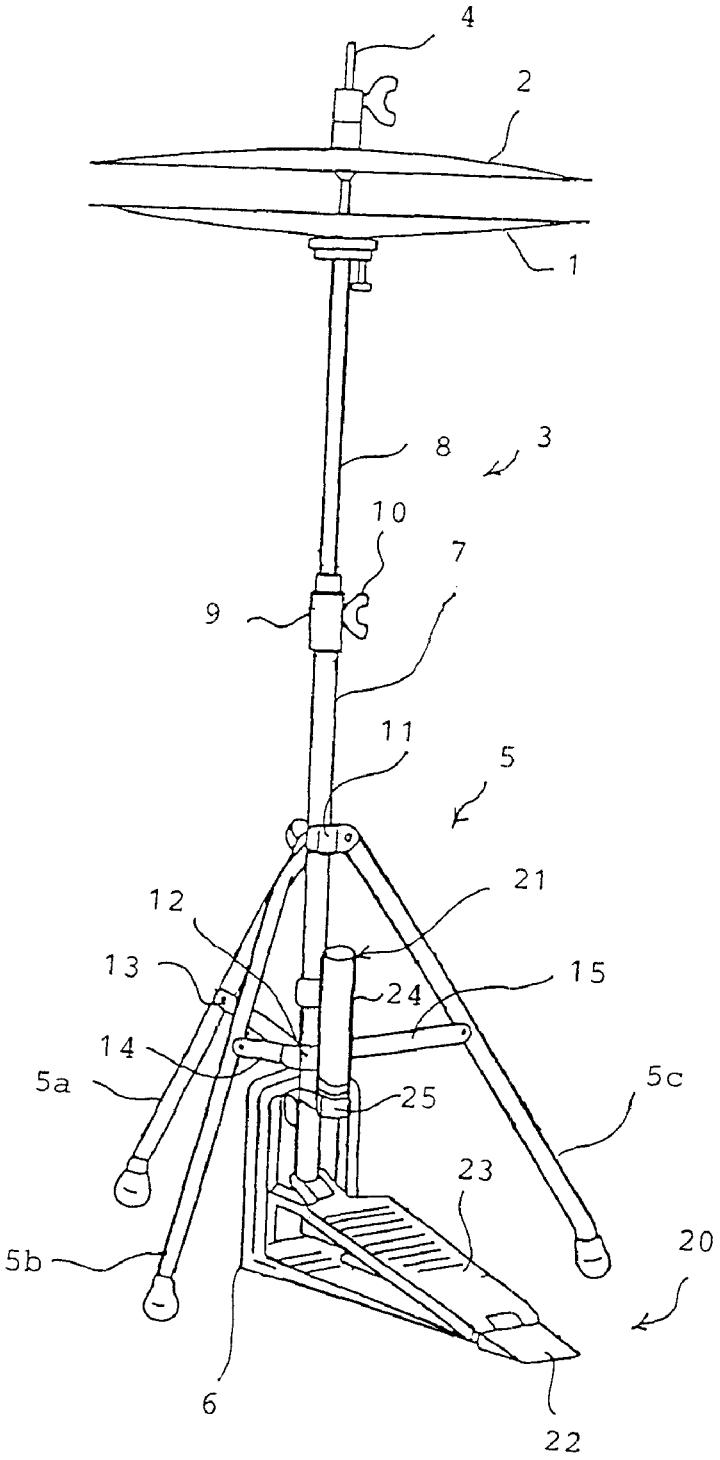
Fig. 1 PRIOR ART
FIG. 1 is a perspective view showing the structure of the prior art stand for cymbals.
Figure 2:
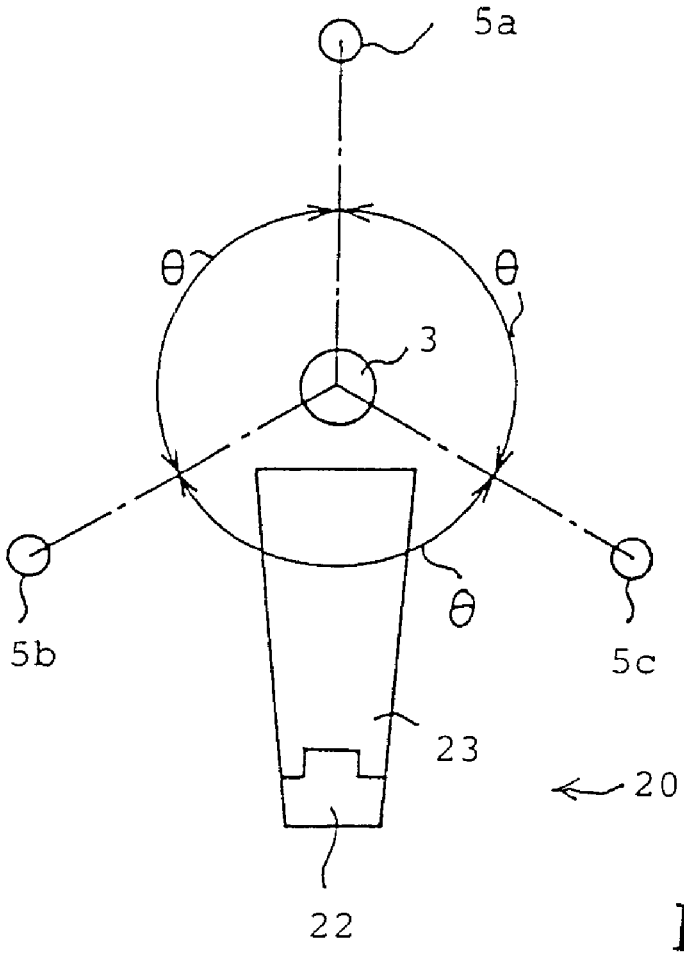
Fig. 2 PRIOR ART
FIG. 2 is a plane view showing the layout of the parts of the prior art high hat cymbals on the floor.
Figure 3:
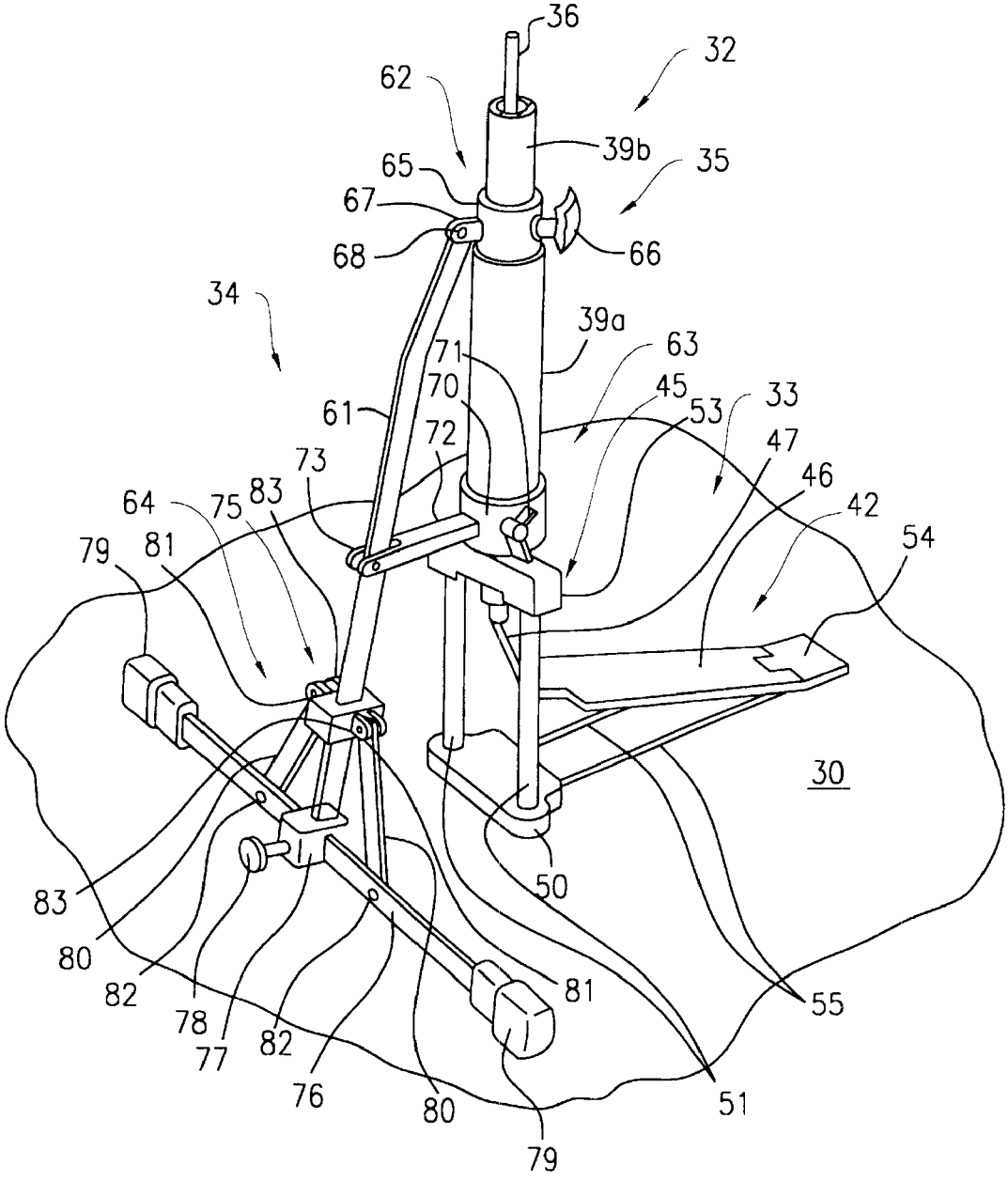
FIG. 3 is a perspective view showing the structure, of a stand for a percussion instrument according to the present invention.
Figure 4:
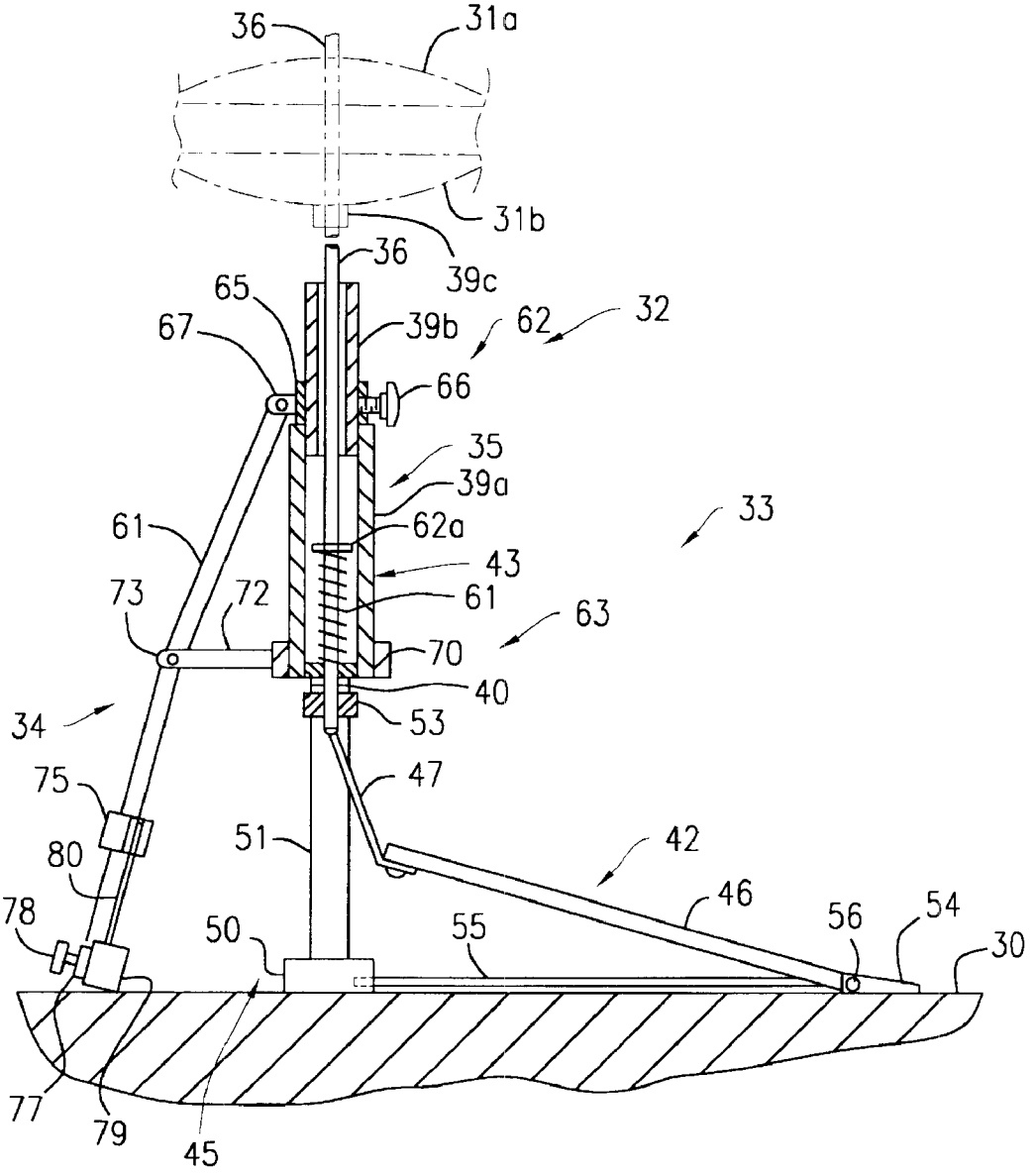
FIG. 4 is a side view showing the stand for a percussion instrument.

Referring to FIGS. 3 and 4 of the drawings, a stand for a percussion instrument is upright on a floor 30, and sustains high hat cymbals 31*a*/31*b* over the floor 30. Thus, the stand is used as a high hat stand. In the following description, term "front" is used to modify a position closer to a player, and term "rear" is used for a position farther than the front position.

The high hat stand comprises a cymbal holder 32, a cymbal driver 33 and a position sustainer 34. The cymbal holder 32 keeps the high hat cymbals as high as the shoulder of a player sitting on a chair, and the cymbal driver 33 crashes the top cymbal 31*a* against the bottom cymbal 31*b* so as to produce clashing sound. The position sustainer 34 is attached to the cymbal holder 32, and keeps the cymbal holder 32 upright on the floor 30.

The cymbal holder 32 includes a telescopic guide 35 and an extension rod 36. Three tubes 39*a*/39*b*/39*c* and caps 40 form in combination the telescopic guide 35. The tube 39*b* is nested into the tube 39*a*, and the tube 39*c* is nested into the tube 39*b*. The tubes 39*b*/39*c* are projectable from and retractable into the other tube 39*a*, together, and the tube 39*c* is projectable from and retractable into the tube 39*b*. One of the caps 40 is attached to the lower end of the pipe 39*a*, and the other cap is attached to the upper end of the pipe 39*c*. The pipes 39*a*/39*b*39*c* and the caps 40 define an inner space in the telescopic guide 35. The extension rod 36 is loosely inserted into the inner space, and projects from both caps 40. Though not shown in the drawings, rings and thumbscrews may be further incorporated in the cymbal holder 32. One of the rings is attached to the upper end of the tube 39*a*, and a female screw is formed in the ring. The thumb screw is brought into thread ed engagement with the ring, and is pressed against the other tube 39*b*. Similarly, the other ring is attached to the pipe 39*b*, and the other thumbscrew is pressed against the pipe 39*c*. Thus, the player can fix the tubes 39*a*39*b*/39*c* to the current relative position with the thumbscrews. The bottom cymbal 31*b* is fixed to the upper end of the tube 39*c*, and the top cymbal 31*a* is fixed to the upper end portion of the extension rod 36. Although the top cymbal/bottom cymbals 31*a*/31*b* are spaced from each other, the top cymbal 31*a* is crashed against the bottom cymbal 31*b* when the player actuates the cymbal driver 33.

The cymbal driver 33 is broken down into a foot pedal 42 and a return spring unit 43. The foot pedal 42 transfers the force exerted by the player to the extension rod 36 for crashing the top cymbal 31*a* against the bottom cymbal 31*b*, and the return spring unit 43 forces extension rod 36 to space the top cymbal 31*a* from the bottom cymbal 31*b*.

The foot pedal 42 is located on the front side with respect to the cymbal holder 32, and includes a frame 45, a foot board 46 and a connecting member 47. The frame 45 is connected to the cymbal holder 32, and receives most of the weight thereof. The foot board 46 is hinged to the frame 45, and is connected to the lower end of the extension rod 36 by means of the connecting member 47. The connecting member 47 is flexible, and converts the rotation to linear motion. When the player steps on the foot board 46, the foot board 46 is rotated with respect to the frame 45, and the connecting member 47 coverts the rotation of the foot board 46 to the linear motion of the extension rod 36 in the downward direction. The connecting member 47 may be formed from a leather belt.

The frame 45 includes a bottom plate 50, a pair of columns 51, an upper beam 53, a heel 54 and a pair of connecting rods 55. The bottom plate 50 is placed on the floor 30, and assembled with the pair of columns 51 and the pair of connected rods 55. The columns 51 are fixed to the bottom plate 50, and upwardly project from the bottom plate 50. The upper beam 53 is bridged over the space between the columns 51, and is fixed to the upper ends of the columns 51. Thus, the telescopic guide 35 is connected to the upper beam 53, and supports the cymbal holder 32 and the high hat cymbals 31*a*/31*b* on the floor 30. The heel 54 is also placed on the floor 30, and is connected to the heel 54 by means of the pair of connecting rods 55. The foot board 46 is connected to the heel 54 by means of a pin 56, and is rotatable around the pin 56. The connecting member 47 is connected at one end thereof to the foot board 46 and at the other end thereof to the lower end of the extension rod 36, and converts the rotation of the foot board 46 around the pin 56 to the downward motion of the extension rod 36.

The return spring unit 43 is provided in the inner space of the telescopic guide 43, and is not seen from the outside. Thus, the return spring unit 43 makes the appearance of the high hat stand neat. The return spring 43 includes a coil spring 61 and a ring 62*a*. The ring 62*a* is fixed to the extension rod 36. The coil spring 61 is spiraled around the extension rod 36, and is connected at the upper end thereof to the ring 62*a* and at the lower end thereof to the cap 40. The distance between the ring 62*a* and the cap 40 is narrower than the free length of the coil spring 61. For this reason, the coil spring 61 is initially compressed, and urges the extension rod 36 upwardly. When the player steps on the foot board 46, the foot board 46 downwardly pulls the extension rod 36 against the elastic force of the coil spring 61, and the top cymbal 31*a* is crashed against the bottom cymbal 31*b*. On the other hand, when the player removes the force from the foot board 46, the coil spring 61 upwardly urges the extension rod 36, and the top cymbal 31*a* is spaced from the bottom cymbal 31*b* due to the elastic force of the coil spring 61. The foot board 46 returns to the initial position. Thus, the player crashes the high hat cymbals 39*a*/31*b* by means of the cymbal driver 33.

The position sustainer 34 prevents the cymbal holder 32 from falling, and is located on the rear side with respect to the cymbal holder 32. The position sustainer 34 includes a single leg 61, two connectors 62/63 and a footing member 64. The connector 62 is provided between the telescopic guide 35 and the upper end portion of the single leg 61, and the single leg 61 is swingable with respect to the telescopic guide 35 by means of the connector 62. The other connector 63 is provided between the telescopic guide 35 and an intermediate portion of the single leg 61. The connector 63 allows the single leg 61 to be stretched from and folded in the vicinity of the telescopic guide 35. Thus, the single leg 61 is changed between a stretched position and a folded position. The single leg 61 in the stretched position forms a triangle together with the pipe 39*a* and the connector 63, and keeps itself stable with respect to the telescopic guide as shown in FIG. 3. On the other hand, when the player changes the single leg 61 to the folded position, the single leg 61 is close to the telescopic guide 35, and the high hat stand becomes compact.

The footing member 64 is attached to the lower end portion of the single leg 61, and is easily disassembled from the leg 61. The footing member 64 is as wide as the two legs of the prior art stand, and is held in contact with the floor 30.

The connector 62 includes a ring 65, a knobbed screw 66, a projection 67 and a pin 68. The ring 65 has an annular space, and the pipe 39*b* is inserted into the annular space. A threaded hole is formed in the ring 65, and knobbed screw 66 is screwed into the threaded hole. The threaded stem of the knobbed screw 66 is pressed against the outer surface of the pipe 39*b*, and the ring 65 is fixed to the pipe 39*b*. The projection 67 is formed on the outer surface of the ring 65, and outwardly projects therefrom. The projection 67 is rearwardly directed. A hole is formed in the leading end of the projection 67, and the leg 61 also has a hole in the leading end portion thereof. The holes are aligned with each other, and the leg 61 is rotatably connected to the projection 67 by means of the pin 68.

The other connector 63 is downwardly spaced from the connector 62, and includes a ring 70, a thumbscrew 71, a stay 72 and a pin 73. The ring 70 has an annular space, and the pipe 39*a* is inserted into the annular space. A threaded hole is formed in the ring 70, and the thumbscrew 71 is screwed into the threaded hole. The threaded stem of the thumbscrew 71 is pressed against the outer surface of the pipe 39*a*, and the ring 70 is fixed to the pipe 39*a*. The stay 72 is hinged to the ring 70, and rearwardly projects therefrom. The stay 72 is bifurcated, and a hollow space is formed in the bifurcated leading end portion of the stay 72. A circular hole is formed in the bifurcated leading end portion, and an elongated hole (not shown) is formed in the intermediate portion of the leg 61. The leg 61 is inserted into the hollow space so as to align the hole with the elongated hole, and the leg 61 is rotatably connected to the stay 72 by means of the pin 73. The pin 73 is movable along the elongated hole so as to take up the difference of the pin position between the stretched position and the folded position. Thus, the connectors 62/63 permit the player to change the single leg 61 between the stretched position and the folded position. When the player loosens the knobbed screw 66 and the thumbscrew 71, the rings 65/70 become slidable on the outer surfaces of the pipes 39*a*/39*b*. The player extracts the rings 65/70 from the telescopic guide 35. Thus, the position sustainer 34 is disassembled from the cymbal holder 32.

The footing member 64 is attached to the lower end portion of the single leg 61, and keeps the cymbal holder 32 stable on the floor 30. The footing member 64 includes a retainer block 75, a plate 76, a connecting block 77, a knobbed screw 78, a pair of anti-slipping blocks 79, a pair of stays 80 and pins 81/81. the through-hole is formed in the retainer block 75, and the lower portion of the leg 61 is slidably inserted into the through-hole. the retainer block 75 has a pair of lug portions 83, and the stays 80 are rotatably connected to the lug portions 83 by means of the pins 81, respectively. A slit is formed in the connecting block 77, and is open to the upper surface of the connecting block 77. The lower end of the leg 61 is inserted into the slit, and the leg 61 is fixed to the connecting block 77. A through-hole is further formed in the connecting block 77, and is open to both side surfaces of the connecting block 77. A threaded hole is further formed in the connecting block 77, and is open to the through-hole. The plate 76 is inserted into the through-hole, and the right wing of the plate 76 is regulated to be equal to the left wing thereof. The knobbed screw 78 is screwed into the threaded hole, and the threaded stem of the knobbed screw 78 is pressed against the plate 76. Thus the layer fixes the plate 76 to the connecting block 77. The right/left wings of the plate 76 are connected to the lower end portions of the stays 80 by means of the pins 82, respectively. The anti-slipping blocks 79 are, by way of example, formed of rubber, and have slits, respectively. The right wings and the left wing are respectively inserted into the slits formed in the anti-slipping blocks 79, and prevents the plate 76 from slippage on the floor 30.

The footing member 64 is easily disassembled from the leg 61. The player loosens the knobbed screw 78. Then, the leg 61 becomes slidable. The player extracts the footing member 64 from the leg 61. Thus, the footing member 64 is disassembled from the leg 61.

As described hereinbefore, the footing member 64 is disassembled from the leg 61, and the connectors 62/63 are disassembled from the telescopic guide 35 together with the leg 61. Thus, the high hat stand according to the present invention is disassembled into at least three parts, and is enhanced in portability.

As will be understood from the foregoing description, the footing member 64 is connected through the single leg 61 to the telescopic guide 35. The footing member occupies two vertexes of a virtual triangle on the floor 30, and the heel 54 occupies the remaining vertex of the virtual triangle. The high hat stand has a center of gravity which falls inside of the virtual triangle. For this reason, even through the single leg 61 is connected to the footing member 64, the position sustainer 34 can prevent the cymbal holder 32 and, accordingly, the high hat cymbals 31*a*/31*b* attached thereto from falling onto the floor 30.

The footing member 64 laterally extends on the floor 30, and only the single leg 61 occupies the space at the back of the cymbal holder 32. For this reason, when a drummer arranges the high hat stand and other percussion instruments in a crowded fashion, the high hat stand is not any obstacle to the other percussion instruments. If the footing member 64 is obstacle to a percussion instrument to be arranged in proximity thereto, the drummer may loosen the knobbed screw 66 and the thumbscrew 71, and turns the single leg 61 and the footing member 64 over a certain angle around the telescopic guide 35. It is necessary for the drummer not to lose the stability of the high hat stand after the turn over the certain angle.

Only the foot pedal 42 occupies the area in front of the cymbal holder 32, and any leg does not occupy the space on both sides of the foot pedal 42. For this reason, the drummer easily accesses high foot onto the foot board 46.

Second Embodiment

Figure 5:
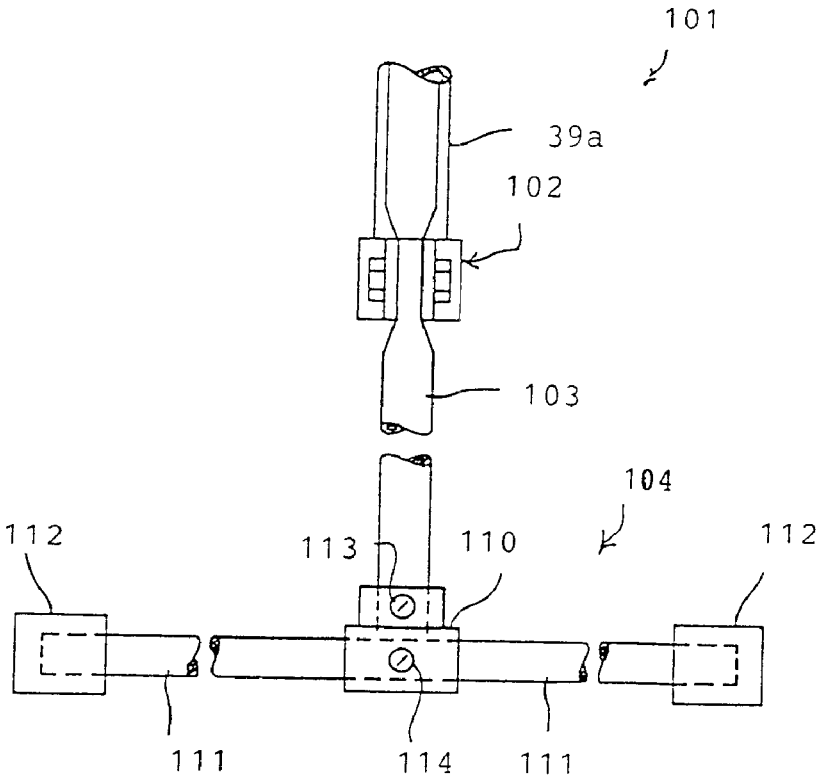
FIG. 5 is a rear view showing a position sustainer incorporated in another stand for a percussion instrument according to the present invention.

Turning to FIG. 5 of the drawings, a position sustainer 101 is incorporated in another high hat stand embodying the present invention. The high hat stand implementing the second embodiment further comprises a cymbal holder and a cymbal driver. However, the cymbal holder and the cymbal driver are similar to those of the first embodiment, and are omitted from FIG. 5 for the sake of simplicity. The lower pipe of the telescopic guide is also labeled with "39*a*".

The position sustainer 101 comprises two couplings 102, a single leg 103 and a footing member 104 as similar to the position sustainer 34. The upper coupling and the lower coupling 102 are similar to the couplings 62 and 63, and no further description is incorporated hereinbelow.

The single leg 103 is implemented by a pipe, and is partially reduced in diameter. The coupling 102 is connected to the reduced portion of the pipe. The footing member 104 includes a connecting block 110, a pipe 110 and a pair of anti-slipping blocks 112. A vertical hole and a lateral hole are formed in the connecting block 110. The single leg 103 is inserted into the vertical hole, and is fixed to the connecting block 110 by means of a bolt 113. The pipe 111 is inserted into the lateral hole, and is connected to the connecting block 110 by means of a bolt 114. The pipe 111 is equally spread on both sides of the connecting block 110. The anti-slipping blocks 112 are attached to the both ends of the pipe 111. The pipe 103 is so large in mechanical strength that any stay is not incorporated in the footing member 101.

Third Embodiment

Figure 6:
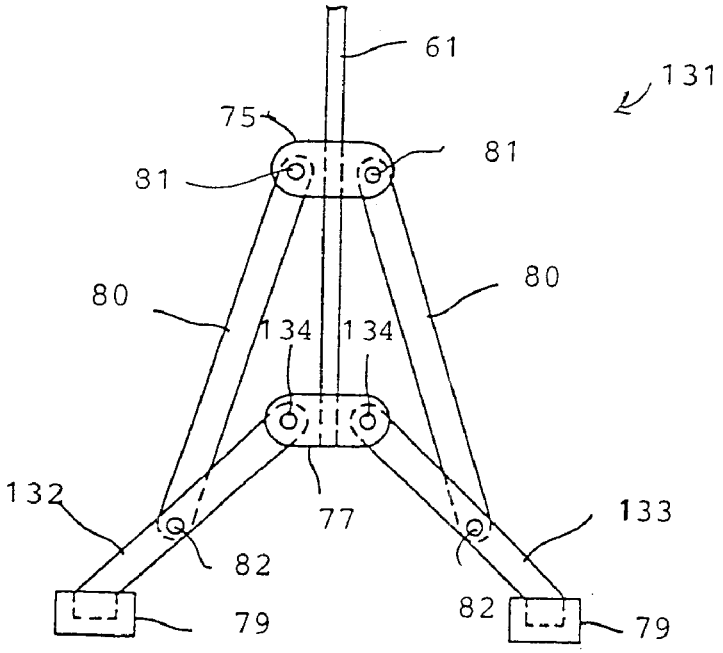
FIG. 6 is a rear view showing a position sustainer incorporated in yet another stand for a musical instrument according to the present invention.

FIG. 6 illustrates a position sustainer 131 incorporated in yet another stand for a musical instrument. The stand may be a high hat stand.

The position sustainer 131 is similar to the position sustainer 64 except for lateral plates 132/133. For this reason, other parts are labeled with same references designating corresponding parts of the position sustainer 64. The single plate 76 is replaced with the pair of plates 132/133, and the plates 132/134 are rotatably connected to the connecting block 77 by means of pins 134. The plates 132/133 are spread on both sides of the single leg 61, and prop the single leg 61 over the floor as shown in FIG. 6. The position sustainer 131 shown in FIG. 6 is in a stretched position.

When a player inwardly exerts force on the plates 132/134, the retaining block 75 slides on the single leg 61, and is closer to the connecting block 77. Accordingly, the plates 132/133 get nearer, and becomes compact. Thus, the player can change the footing member 131 between the stretched position and a folded position. The foldable footing member 131 enhances the portability of the high hat stand.

Fourth Embodiment

Figure 7:
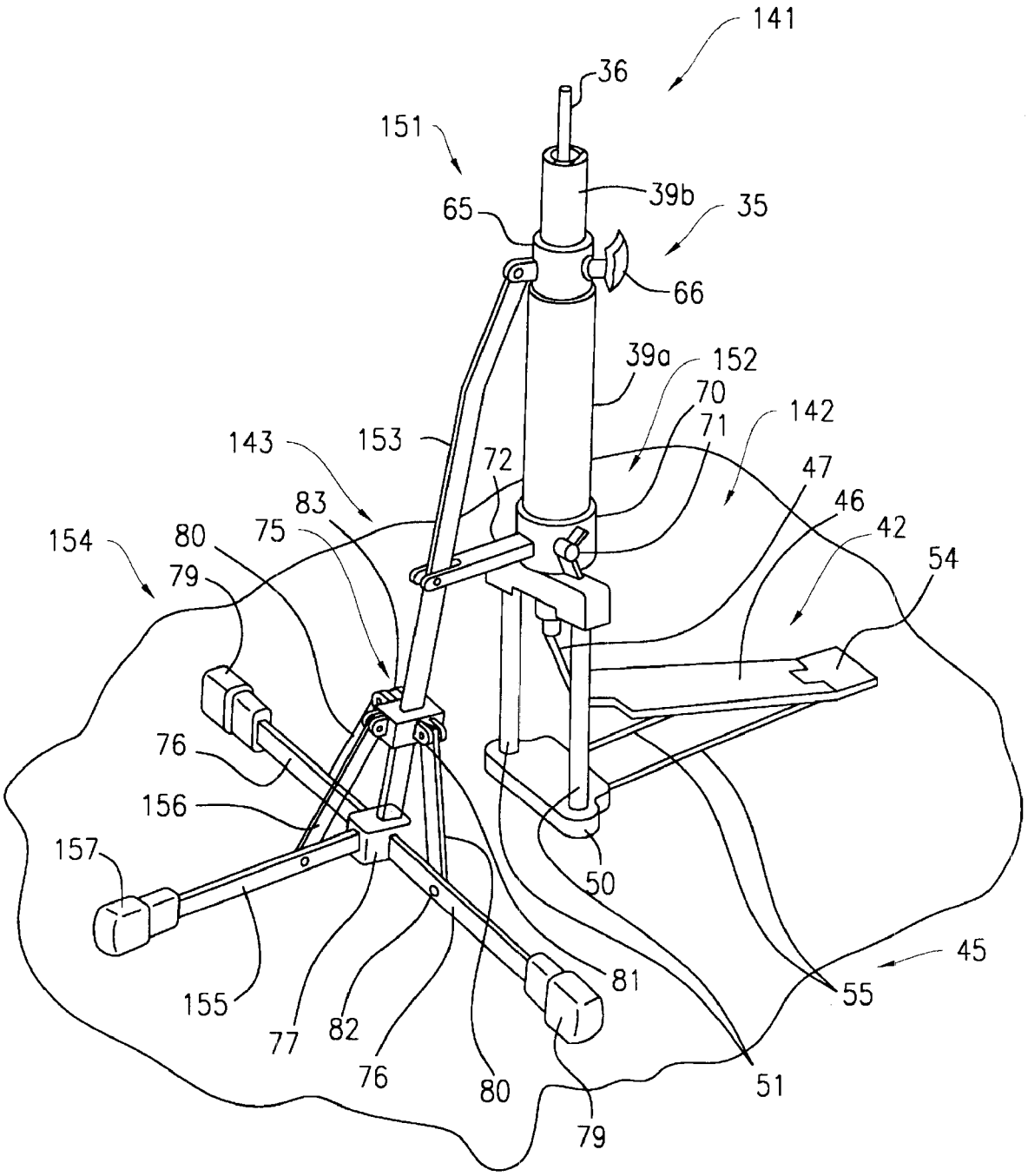
FIG. 7 is a perspective view showing the structure of still another stand for a percussion instrument according to the present invention.

Turning to FIG. 7 of the drawings, still another stand for a musical instrument embodying the present invention largely comprises a cymbal holder 141, a cymbal driver 142 and a position sustainer 143. The cymbal holder 141 and the cymbal driver 142 are similar to those of the first embodiment, and parts are labeled with the same references designating corresponding parts of the first embodiment without detailed description for the sake of simplicity.

The position sustainer 143 also includes couplings 151/152, a single leg 153 and a footing member 154. The coupling 151/152 and the single leg 153 are similar to those of the first embodiment, and parts are labeled with the same references. The footing member 154 is different from the footing member 64 in that a plate 155 is added, and a stay 156 and an anti-slipping block 157 are further provided for the additional plate 155. Other parts of the footing member 154 are labeled with the same references designating corresponding parts of the footing member 64. The additional plate 155 rearwardly projects from the connecting block 77, and extends on the floor 30. The stay 156 is connected at one end thereof to the retainer block 75 and at the other end thereof to the additional plate 155. The anti-slipping block 157 is, by way of example, formed of rubber, and is attached to the leading end of the additional plate 155.

The additional plate 155 enhances the stability of the stand. Even if a musical instrument on the cymbal holder 141 offsets the center of gravity toward the rearward position. The additional plate 155 prevents the stand and the musical instrument from falling.

In the above-described embodiments, the combination of plate 76 and anti-slipping blocks 79, the combination of pipe 111 and anti-slipping blocks 112, the combination of plates 132/133 and anti-slipping blocks 79 and the combination of plate 76, anti-slipping blocks 79, additional plate 155 and anti-slipping block 157 serve as a foot.

Although particular embodiments of the present invention have been shown and described, it will be apparent to those skilled in the art that various changes and modifications may be made without departing from the spirit and scope of the present invention.

The application of the stand is not limited to the high hat stand. The present invention is applicable to any stand equipped with a foot pedal. For example, a motion converter may be attached to the guide so as to convert the reciprocal motion of the extension rod to rotation. In this instance, a beater may be connected to the motion converter so as to be driven for rotation. The beater may be used for producing percussion instrument such as, for example, a drum.

The right wing and the left wing of the plate 76 may project from the connecting block 77 at a certain angle.

The plates 132/133 may be on the straight in the stretched position. In this instance, the retainer block 75 is lower than that of the third embodiment, and the position sustainer 131 offers a wide free space.

A circular member may be further provided around the single leg 61 in such a manner that said plate 76 is connected thereto.

What is claimed is:

1. A stand for a musical instrument, comprising:

a holder for keeping said musical instrument over a surface;

a driver placed on said surface, connected to said holder for keeping said holder and said musical instrument over said surface, and linked with said musical instrument so that a player produces sound by actuating said musical instrument through said driver; and a position sustainer for preventing said holder and said musical instrument from falling, and including a single leg having one end portion connected to said holder and extending toward said surface and a footing member connected to another end portion of said single leg and held in contact with said surface.

2. The stand as set forth in claim 1, in which said driver includes a frame connected to a lower portion of said holder and a foot pedal placed on said surface and having a foot board rotatable with respect to said frame for actuating said musical instrument.

3. The stand as set forth in claim 2, in which said holder includes a guide connected at a lower portion of said guide to said frame and having an inner space and an extension rod slidably accommodated inside said guide and having a lower end portion connected to said foot pedal, said musical instrument is connected between an upper end portion of said guide and an upper end portion of said extension rod so that said player actuates said musical instrument by means of said foot pedal.

4. The stand as set forth in claim 3, in which said musical instrument has a first cymbal connected to said upper end portion of said guide and a second cymbal connected to said upper end portion of said extension rod.

5. The stand as set forth in claim 1, in which said footing member is foldable.

6. The stand as set forth in claim 1, in which said single leg is formed by a pipe.

7. A stand for a musical instrument, comprising:

a holder for keeping said musical instrument over a surface; a driver placed on said surface, connected to said holder for keeping said holder and said musical instrument over said surface, and linked with said musical instrument so that a player produces sound by actuating said musical instrument through said driver; and a position sustainer for preventing said holder and said musical instrument from falling, and including a single leg having one end portion connected to said holder and extending toward said surface and a footing member connected to another end portion of said single leg and held in connect with said surface, said footing member being foldable and including a retainer block connected to said other end of said single leg, propping members rotatably connected to both sides of said connecting block, and stays rotatably connected at lower ends thereof to said propping members and at upper ends thereof to said retainer block so that said propping members get nearer and spaced.

8. A stand for a musical instrument, comprising:

a holder for keeping said musical instrument over a surface;

a driver placed on said surface, connected to said holder for keeping said holder and said musical instrument over said surface, and linked with said musical instrument so that a player produces sound by actuating said musical instrument through said driver; and a position sustainer for preventing said holder and said musical instrument from falling, and including a single leg having one end portion connected to said holder and extending toward said surface and a footing member connected to another end portion of said single leg and held in connect with said surface in which said footing member has a retainer block connected to an intermediate portion of said single leg, a connecting block connected to said other end of said single leg, and a foot connected to said connecting block and held in contact with said surface.

9. The stand as set forth in claim 8, in which said foot has a single bar passing through said connecting block in such a manner as to sidewardly project therefrom, and anti-slipping blocks attached to both ends of said single plate.

10. The stand as set forth in claim 9, in which said anti-slipping blocks and a foot pedal occupies three vertexes of a virtual triangle on said surface, and said holder includes a guide connected at a lower portion thereof to a frame of said driver placed on said surface and an extension rod slidably accommodated inside of said guide and having a lower end portion connected to said foot pedal so that said musical instrument is connected between an upper end portion of said guide and an upper end portion of said extension rod.

11. The stand as set forth in claim 10, in which said musical instrument has a first cymbal connected to said upper end portion of said guide and a second cymbal connected to said upper end portion of said extension rod.

12. The stand as set forth in claim 11, in which said foot has a single bar passing through said connecting block in such a manner as to sidewardly project therefrom, and anti-slipping blocks attached to both ends of said single plate.

13. The stand as set forth in claim 12, in which said anti-slipping blocks and a foot pedal occupies the three vertexes of the virtual triangle on said surface, and said holder includes a guide connected at a lower portion thereof to a frame of said driver placed on said surface and an extension rod slidably accommodated inside of said guide and having a lower end portion connected to said foot pedal so that said musical instrument is connected between an upper end portion of said guide and an upper end portion of said extension rod.

14. The stand as set forth in claim 13, in which said musical instrument has a first cymbal connected to said upper end portion of said guide and a second cymbal connected to said upper end portion of said extension rod.

15. A stand for a musical instrument, comprising:

a holder for keeping said musical instrument over a surface;

a driver placed on said surface, connected to said holder for keeping said holder and said musical instrument over said surface, and linked with said musical instrument so that a player produces sound by actuating said musical instrument through said driver; and a position sustainer for preventing said holder and said musical instrument from falling, and including a single leg having one end portion connected to said holder and extending toward said surface and a footing member connected to another end portion of said single leg and held in contact with said surface, said footing member having a retainer block connected to an intermediate portion of said single leg, a connecting block connected to said other end of said single leg, a foot connected to said connecting block and held in contact with said surface, and a stay connected between said retainer block and said foot.

16. The stand as set forth in claim 15, in which said foot has three bars projecting from said connecting block in different directions, and three anti-slipping blocks attached to the leading ends of said three bars, respectively, and said stay has three bars connected at upper ends thereof to said retainer block and at lower ends thereof to said three bars.

17. The stand as set forth in claim 16, in which said three bars are located on an area opposite to a foot pedal of said driver with respect to said holder, and said holder includes a guide connected at a lower portion thereof to a frame of said driver placed on said surface and an extension rod slidably accommodated inside of said guide and having a lower end portion connected to said foot pedal so that said musical instrument is connected between an upper end portion of said guide and an upper end portion of said extension rod.

18. The stand as set forth in claim 17, in which said musical instrument has a first cymbal connected to said upper end portion of said guide and a second cymbal connected to said upper end portion of said extension rod.

* * * * *